US005956826A

United States Patent [19]

Willisford et al.

[11] Patent Number: 5,956,826

[45] Date of Patent: Sep. 28, 1999

[54] DUST REMOVAL APPARATUS AND METHOD FOR TEXTILE MACHINE

[75] Inventors: Glenn R. Willisford, Auburn; T. Cooper Perry, Roanoke, both of Ala.

[73] Assignee: West Point Foundry and Machine Company, West Point, Ga.

[21] Appl. No.: 09/083,463

[22] Filed: May 22, 1998

[51] Int. Cl.[6] ..... D02H 11/00

[52] U.S. Cl. ..... 28/173; 15/309.1

[58] Field of Search ..... 28/173, 222, 172 R, 28/178, 179; 15/301, 303, 306.1, 309.1, 316.1; 139/1 C

[56] References Cited

U.S. PATENT DOCUMENTS

| | | | |
|---|---|---|---|
| 1,553,217 | 9/1925 | Cooper et al. . | |
| 1,596,455 | 8/1926 | Rowe, Jr. et al. . | |
| 1,703,852 | 2/1929 | Davis | 28/173 |
| 2,140,420 | 12/1938 | Eaddy | 28/173 |
| 2,695,039 | 11/1954 | Holtzclaw | 28/173 |
| 2,812,251 | 11/1957 | Miller et al. | 28/173 |
| 2,984,263 | 5/1961 | Loepsinger | 28/173 |
| 4,333,201 | 6/1982 | Rohner . | |
| 4,926,531 | 5/1990 | Koslowski et al. . | |
| 4,944,077 | 7/1990 | Bollen | 28/173 |
| 5,177,832 | 1/1993 | McCoy | 15/309.1 |

*Primary Examiner*—Amy B. Vanatta
*Attorney, Agent, or Firm*—Jones & Askew

[57] ABSTRACT

Apparatus and method for removing an induced flow of particulate-bearing air traveling with a moving yarn sheet in a winding apparatus such as a textile warping machine. An air nozzle produces a thin sheet of air moving in a counter-flow direction to the induced air flow, and located adjacent the carrier roll of the warper. The air sheet entrains a volume of ambient air for movement with the air sheet, and the mass flow of the counterflow-moving air is sufficient to redirect the induced air from the yarn sheet for removal from the warper. An optional second nozzle may provide additional air entrainment above the moving yarn sheet, upstream from the carrier roll, thereby entraining a flow of air moving through the yarn sheet to divert dust and other particulates traveling on or with the yarn sheet.

15 Claims, 5 Drawing Sheets

DUST REMOVAL APPARATUS AND METHOD FOR TEXTILE MACHINE

FIELD OF THE INVENTION

This invention relates in general to textile machines, and relates in particular to controlling and removing dust and other particulate matter encountered in textile winding machines.

BACKGROUND OF THE INVENTION

Textile machines are known for producing substantial quantities of airborne particulate matter while processing fibers into woven fabric. These particulates may range from relatively small micron-size dust particles to relatively coarse particulates such as lint or the like. Airborne particulates are especially problematic with textile warping or beaming machines, which draw a number of individual threads from a creel of bobbins to form a sheet-like web of yarns that are wound onto a warping beam. The yarns are withdrawn from the bobbins and travel toward the beam at linear speeds in excess of 400 yards per minute. The sheet of yarns traveling at those speeds induces an air stream that travels with the yarn sheet, and carries dust and lint from the yarns and from the ambient air around the machine. This air stream follows the moving yarn sheet to the carrier roll of the warping apparatus, over which the yarn sheet passes before winding onto the beam. The particulate-laden air stream becomes attached to the curved surface of the carrier roll, which deflects the path of the induced air to blow from the warping machine toward the location where a machine operator may stand to inspect the beaming operation in progress.

Past attempts to control dust or other particulate matter in beaming apparatus usually call for exhausting the particulate-laden air from the machine and its immediate surroundings. One such apparatus is described in U.S. Pat. No. 4,926,531, which discloses a protective structure surrounding and substantially enclosing the beaming apparatus. An air extractor hood is arranged above the winding machine and is connected to a fan for removing air over the machine. Dust-bearing air thus is removed from the vicinity of the machine and is filtered or discharged to the atmosphere. That apparatus appears to require a major and relatively expensive refit of existing warping machines, and does not directly deal with the flow of induced air created by the yarn sheet moving at high speed toward the machine operator.

SUMMARY OF THE INVENTION

Stated in general terms, the present invention redirects the induced flow of particulate-laden air from the moving sheet of yarn before the induced air flow can reach the area occupied by the machine operator. This redirection of the induced airflow is accomplished by directing a flow of air toward the induced airflow, at a volume and velocity sufficient to redirect the induced air from the yarn sheet. The redirected flow of dirty air is then exhausted from the winding apparatus for filtering or other handling.

Stated in somewhat greater detail, the induced flow of particulate-laden air is redirected by a stream of air flowing at substantial velocity from a nozzle or other outlet. The flow and velocity of that air stream emitted from the nozzle is sufficient to entrain a volume of surrounding air moving with the air flow from the nozzle. The amount of that entrained air preferably is several times greater than the volume of air emitted from the nozzle, and the greater volume of air is combined with the air stream from the nozzle to redirect the induced flow of dirty air from the yarn sheet.

Stated more particularly, the air nozzle of the present invention preferably is located on a side of the conventional yarn-sheet carrier roll opposite from the entry path of the yarn sheet onto that roll. The nozzle at that location directs the flow of air having at least a component of movement in a counterflow direction to the stream of induced air moving with the yarn sheet and normally flowing over the surface of the carrier roll. The counterflow of air from the air outlet apparatus, including the surrounding air entrained by that air flow, is sufficient to redirect the entrained air away from the yarn sheet arriving at the carrier roll before the induced air can attach to and flow around the rotating carrier roll. The air entrained by the air outlet apparatus is drawn into the warping machine from the vicinity of the location occupied by the machine operator, and that inward flow of ambient air further reduces the chance that dust or other particulates can escape from the warper to infiltrate that location. The redirected particulate-laden air stream, along with the air flowing from the air outlet apparatus and the air entrained thereby, is directed toward a suitable exhaust duct for removal from the winding machine.

Initial removal of dust and other particulates according to the present invention also optionally takes place upstream from the carrier roll, before the yarn sheet arrives at that roll. To accomplish that optional removal, a second air outlet apparatus is located at one side of the path of the yarn sheet, to direct a flow of air in a direction at an acute angle to the yarn sheet and diverging from the yarn sheet, so that the surrounding air entrained by the flow from the second air outlet comes at least in part from the side of the moving yarn sheet opposite to the location of the second air outlet. This entrained air flow is drawn through the moving yarn sheet from the side opposite the second air outlet, whereupon the entrained air moves with the entraining air jet from the second air outlet along an acute path diverging from the path of the yarn sheet. This entrained air flowing through the yarn sheet diverts and removes at least a portion of the dust and lint carried by the moving yarns and by the induced air traveling with the moving yarn sheet. The air and particulates as thus removed pass to a suitable exhaust for removal from the winding machine.

Accordingly, it will be seen that an object of the present invention is to provide an improved apparatus and method for removing dust and other particulates from winding apparatus.

It is another object of the present invention to provide an improved winding apparatus and method.

It is a further object of the present invention to provide an apparatus and method for preventing or significantly reducing the amount of dust and other particulates otherwise escaping from a textile winding machine.

Other objects and advantages of the present invention will become more readily apparent from the following description of a preferred embodiment.

DETAILED DESCRIPTION OF PREFERRED EMBODIMENT

Figure 1:
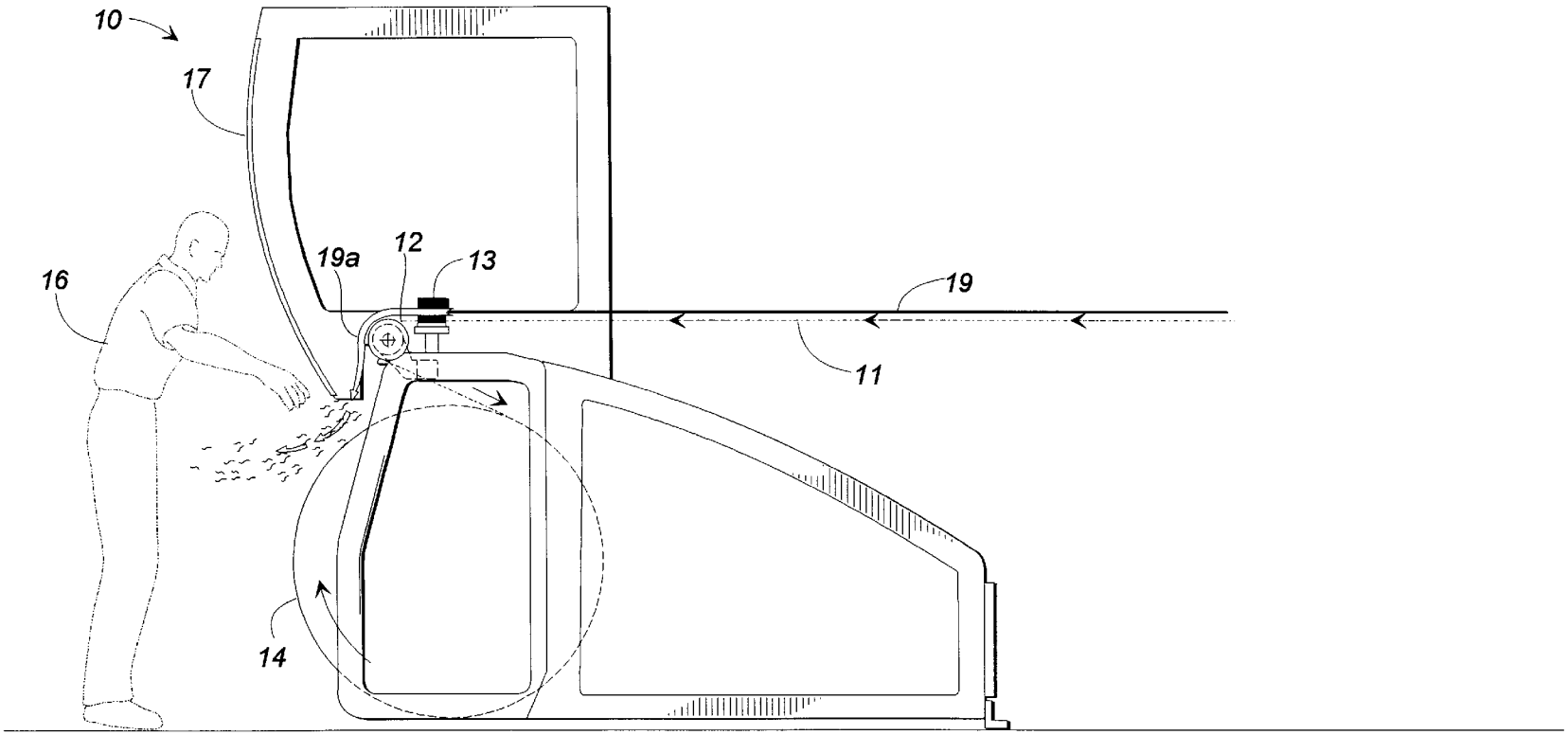
(PRIOR ART) FIG. 1
FIG. 1 is a elevation view showing a textile beaming apparatus according to the prior art and illustrating the problem overcome by the present invention.

FIG. 1 shows generally at 10 a typical warping apparatus not equipped according to the present invention. In the warping apparatus 10, a number of parallel yarns from the creel (not shown) enter the warper along a plane yarn path 11, seen edgewise in FIG. 1. The moving yarns 11 form what is known as a yarn sheet, and that yarn sheet travels through the comb 13 and around the carrier roll 12 of the warper. The yarn sheet then travels downwardly from the carrier roll for winding to form the beam 14, located below the carrier roll. A machine operator 16 stands in front of the warper and observes the progress of the beaming operation, to stop operation of the warper if a yarn breaks or some other problem occurs during a beaming operation. A window 17 and a safety bar (not shown) separate the machine operator from the rotating carrier roll and the beam, and suitable interlocks shut down operation of the warper if the safety bar is displaced.

During a beaming operation, the yarn sheet 11 may travel at linear speeds presently ranging from 400–1,200 yards per minute as the yarn sheet moves toward the carrier roll 12. The yarn sheet moving at high speeds induces a stream of air sometimes known as windage and traveling substantially parallel to the path of the moving yarn sheet. The arrow 19 represents the induced air flow traveling with the moving yarn sheet. Those skilled in the art will appreciate that the induced air flow 19 typically carries airborne dust, lint, and other particulate matter from the individual yarns and from the ambient air surrounding the yarns traveling from the creel to the warper. As this induced flow of dirty air arrives at the carrier roll 12, the air stream becomes temporarily attached to the curved surface of the carrier roll, due to the tendency of a high-velocity stream of fluid to become attached to a curved surface even when that surface curves away from the nominal axis of the air stream. This tendency of a fast-moving air stream is known as the Coanda effect. As seen in FIG. 1, the induced air stream 19 travels part way around the surface of carrier roll 12 as shown at 19*a,* and then at least partially separates from the surface of the carrier roll to flow downwardly along a path beneath the safety shield 17. The dust-laden flow of induced air thus blows out of the warper and into the space occupied by the machine operator, subjecting that person to the stream of induced air and to the dust and other particulates carried by that flow.

Figure 2:
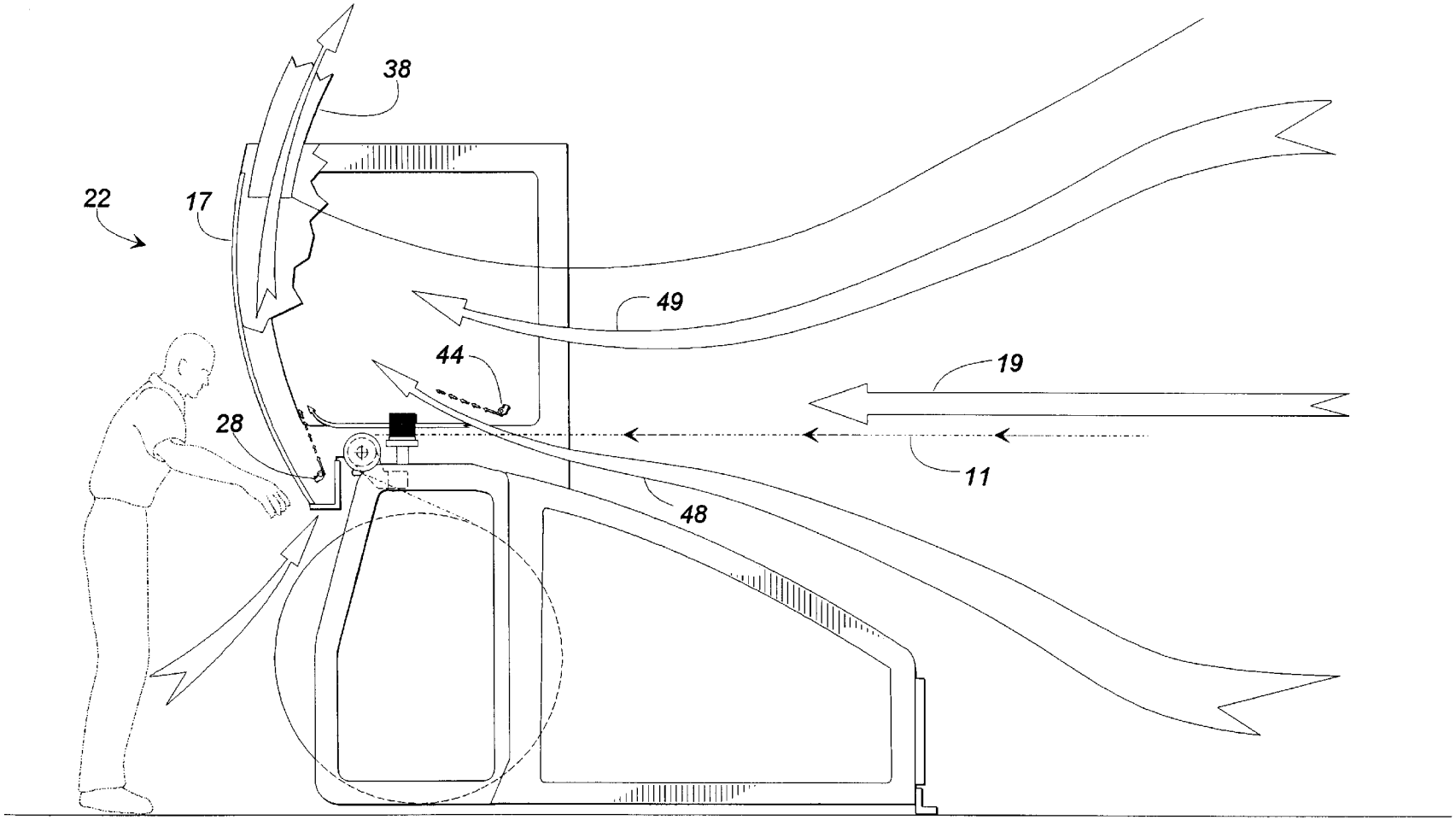
FIG. 2 is a partially-schematic side elevation view showing a textile beaming apparatus according to a preferred embodiment of the present invention.
Figure 3:
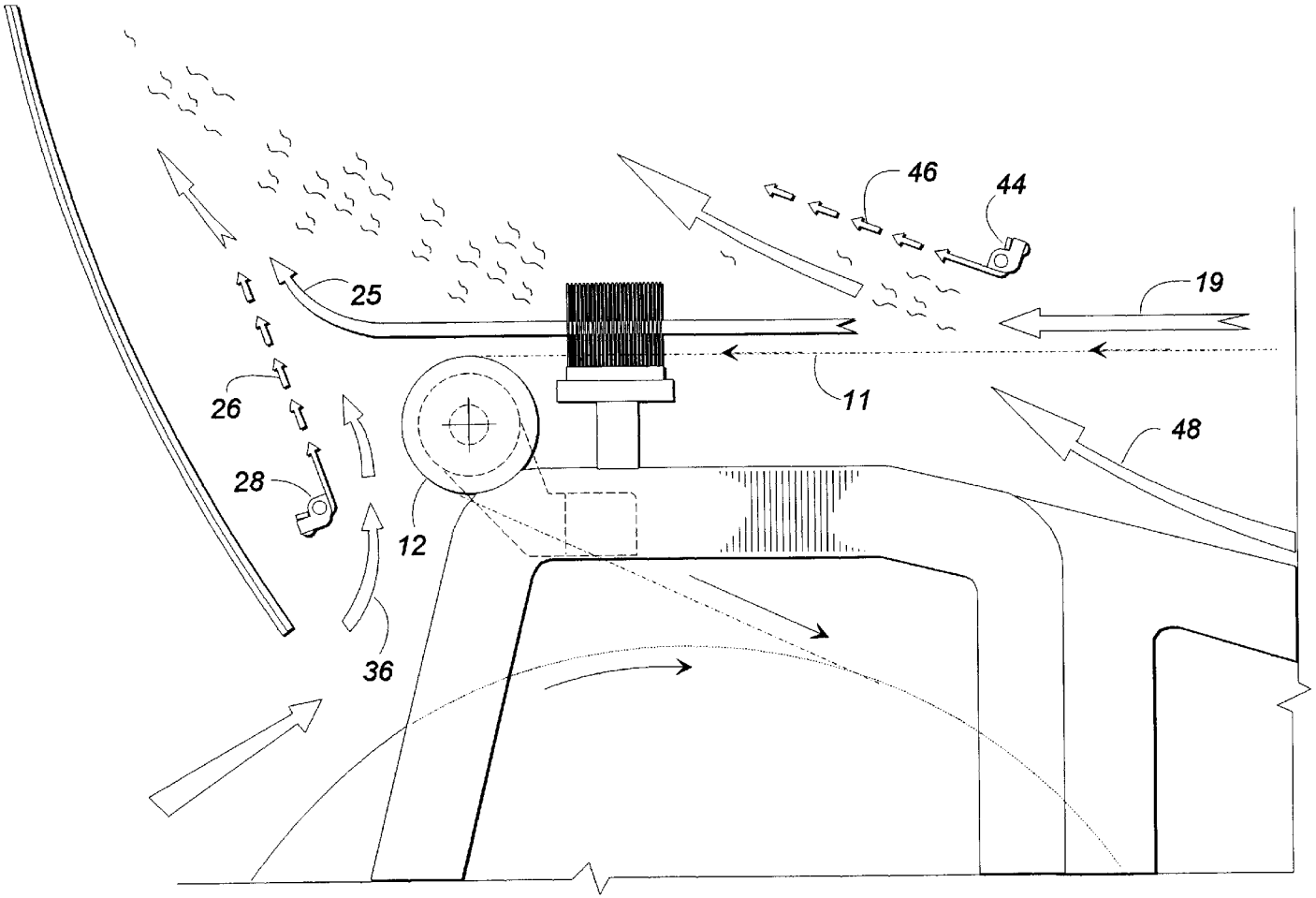
FIG. 3 is an enlarged view showing a portion of the apparatus in FIG. 2.
Figure 4:
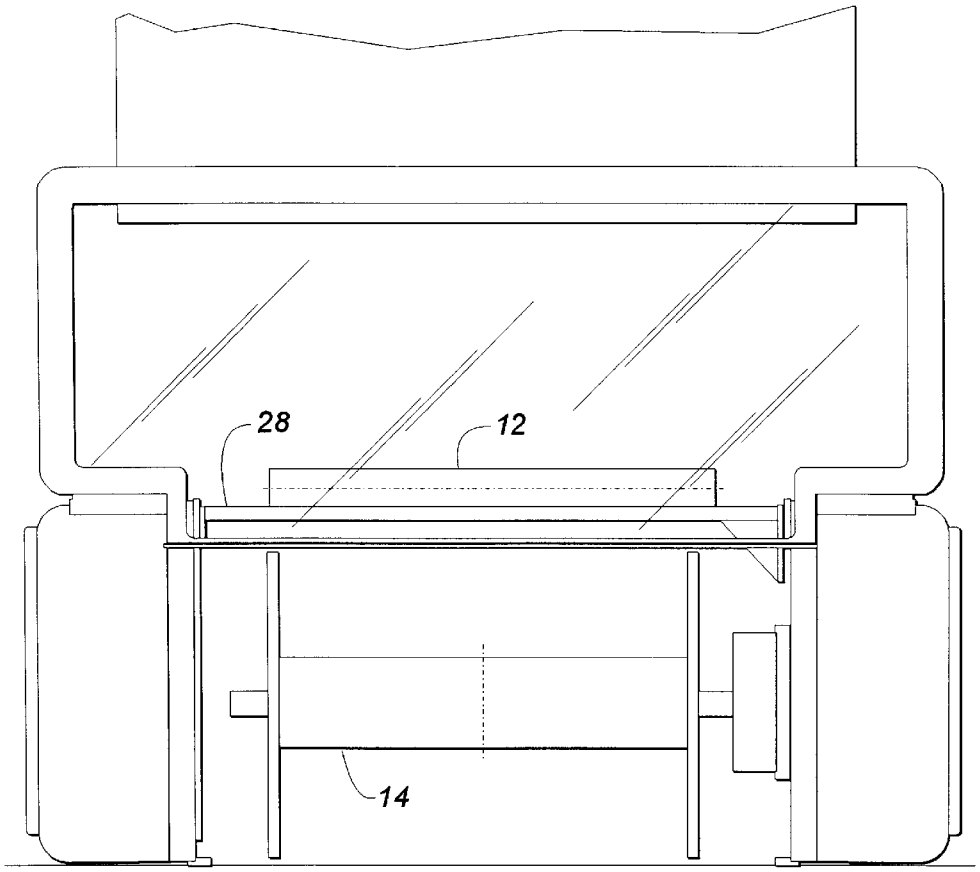
FIG. 4 is a front elevation view of the apparatus shown in FIG. 2.
Figure 5:
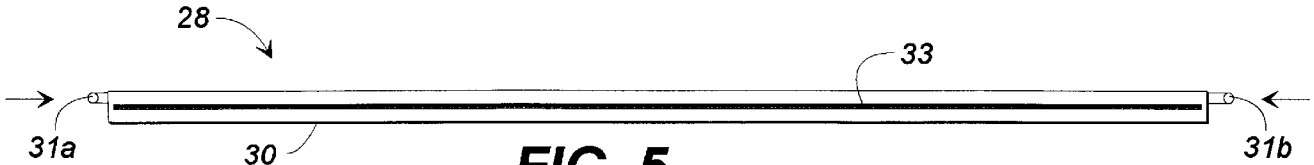
FIG. 5 is a top view showing details of the air outlet apparatus in the embodiment of FIGS. 2–4.

Turning now to FIGS. 2 and 3, there is a warping apparatus shown generally at 22 and equipped according to a preferred embodiment of the present invention. The flow of induced air travels with the moving yarn sheet 11 on an entry path leading to the carrier roll 12, as explained above. However, the induced air flow arriving at the carrier roll 12 is subjected to a force that redirects the induced air flow upwardly and away from the carrier roll, as shown at 25 in FIG. 3. This force is provided in the preferred embodiment by a thin sheet 26 of air emitted at high velocity from a nozzle 28 or similar air outlet structure located adjacent the carrier roll 12 on the side opposite the entry path of the yarn sheet 11 moving toward the carrier roll. The nozzle structure 28 is located slightly below the axis of rotation of the carrier roll 12, as best seen in FIG. 3, although that particular location is not considered essential to the present invention. As best seen in FIGS. 4 and 5, the nozzle structure comprises an elongated plenum 30 extending across the width of the yarn sheet and connected to an appropriate source of compressed air by the air lines 31*a,* 31*b* at opposite ends of the plenum. The nozzle itself is formed by a narrow slot 33 in the plenum, the slot extending across the width of the yarn sheet and preferably extending somewhat beyond each side of the yarn sheet, as seen in FIG. 4. The slot 33 on the plenum 30 thus extends on a path transverse to the longitudinal axis of the yarn sheet 11 and preferably occupies a plane parallel to the yarn sheet.

For most effective results, it has been found that the slot 33 should be relatively narrow in width, producing a corresponding high velocity of the compressed air escaping the plenum through that slot. In a working embodiment of the present invention, a slot width on the order of 0.001 in. is used to good effect. Such relatively narrow slot-like nozzles are commercially available and sometimes are known as air knives.

The operation of the dust removal apparatus as described thus far is best understood with reference to FIG. 3. The nozzle 28 emits a thin sheet of air 26 moving at a relatively great velocity, in a generally counterflow direction to the path 19*a* (FIG. 1) the induced air flow would normally travel while becoming attached to the surface of the carrier roll 12. The high-velocity sheet of air 26 emitted from the nozzle 28 entrains a volume of air drawn into the warping apparatus from the region occupied by the machine operator. The volume of air entrained by the air 26 from the nozzle 28 is on the order of 30 times the volume of entraining air flow from that nozzle, in an actual embodiment. This flow of entrained air, shown by the arrows 36 in FIG. 3, travels with the sheet of air 26 from the nozzle 28, so that the entrained air likewise moves past the carrier roll 12 in a generally counterflow direction. The combined mass flow rate of the air sheet 26 and the entrained air 36 is sufficient to redirect the induced air flow 19 from its nominal path, parallel to the moving yarn sheet 11 and following the surface of the carrier roll, to a generally upward-directed path as shown at 25. The combined volume of the redirected induced air flow 25, the air sheet 26, and the entrained air 36 thus flows upwardly toward an exhaust duct 38 (FIG. 2) located at an upper part of the warping apparatus, behind the window 17. The exhaust duct 38 preferably is connected to any suitable air removal and filtration apparatus, so that the combined air flows and the particulates carried by the induced air flow 19 are removed from the warping apparatus 22. The particulate-laden flow of induced air thus is substantially or completely separated from a machine operator standing in front of the warper, and the inflow of entrained air 36 from that location further helps prevent dust or other particulates from flowing into that area during a beaming operation.

Figure 6:
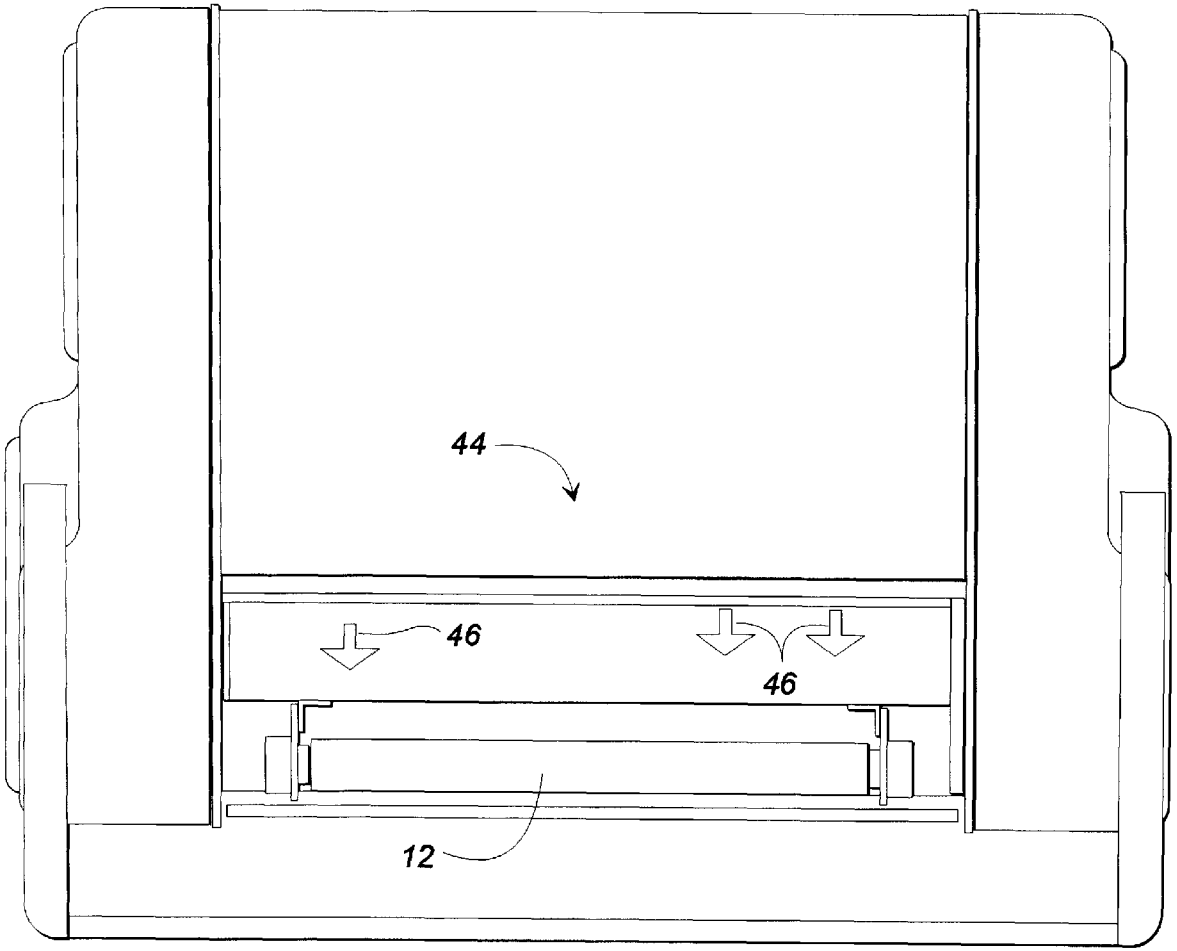
FIG. 6 is a partial plan view of the apparatus shown in FIGS. 2 and 3.

The improved warper as described thus far may optionally include a second nozzle 44 entraining air to help remove dust and other particulates from the induced air flow and from the yarn sheet arriving at the warper. This second nozzle 44 is located above the path of the yarn sheet 11 and upstream from the carrier roll 12, as best seen in FIGS. 3 and 6. The second nozzle 44, which may be structurally and functionally identical to the nozzle 28 previously described, receives a supply of compressed air and produces a thin sheet of air denoted by the arrows 46 in those figures. The second nozzle 44 directs the air sheet 46 along a path diverging upwardly and away from the moving yarn sheet 11 and generally in the same direction as the movement of the yarn sheet. The air sheet 46 thus has a horizontal component of movement parallel to the yarn sheet 11 and a vertical component perpendicular to and extending outwardly from the yarn sheet.

The sheet of air 46 from the second nozzle has a flow rate sufficient to entrain substantial amounts of ambient air for movement with that air sheet. A first component of the entrained air flows upwardly from below the yarn sheet 11, and the arrow 48 illustrates that air path. Another component 49 (FIG. 2) of the air entrained by the air sheet 46 arrives from above the yarn sheet 11, that is, on the same side of the yarn sheet as the second nozzle 44. Both entrained air flows 48 and 49 move generally concurrent with the air sheet 46, flowing toward the front of the warper 22 along a path leading to the exhaust duct 38. Those air flows caused by the optional second nozzle 44 thus are removed from the warper along with the direct and entrained air flows from the first-described nozzle 28.

The entrained air flow 48 from below the yarn sheet passes between the individual yarns making up the yarn sheet 11, and that flow picks up at least some of the particulate matter traveling with the induced air flow 19 moving with the yarn sheet. The entrained air flowing through the yarn sheet may also dislodge and carry away particles of dust or lint on the individual yarns. Those particulates are born to the exhaust duct 38 by the combined air streams resulting from the output of the second nozzle 44. Moreover, those combined air flows caused by the air sheet 46 from the second nozzle also may deflect the induced air flow 19 away from the yarn sheet 11 as that induced air flow approaches the carrier roll 12. Deflection of the induced air flow 19 causes that air flow to arrive at the carrier roll 12 diverging outwardly to some extent from the surface of the carrier roll, instead of arriving substantially tangent to that roll as illustrated in FIG. 1. The outward divergence of the arriving air stream 19 weakens the attachment of that air stream to the curved surface of the carrier roll, thereby improving the effectiveness of the air sheet 26 from the first-mentioned nozzle 28 in redirecting the induced air flow 19 away from the carrier roll.

It should be understood that the foregoing relates only to a preferred embodiment of the present invention, and that numerous other modifications and changes may be made thereto without departing from the spirit and scope of the invention as defined in the following claims.

I claim:

1. Improved apparatus for winding a sheet of yarns traveling at speeds sufficient to induce a stream of air moving with the yarn sheet and carrying dust or other particulates, comprising:

a roll having a surface to receive the yarn sheet moving on an entry path toward a carrier roll and operative to redirect the yarn sheet to an exit path angularly displaced from the entry path, whereat the induced air flow normally follows the surface of the carrier roll and becomes at least partially separated from the yarn sheet, whereupon the air and particulates escape the apparatus and flow into an area intended for a machine operator; and an air outlet structure receiving a supply of compressed air and positioned adjacent the roll to direct a flow of air toward the induced stream of air at a flow and velocity operative to redirect the induced air from the yarn sheet for removal from the apparatus, whereby the air flow from the air outlet apparatus separates the induced air and particulates from the yarn sheet before the induced air can follow the surface of the carrier roll.

2. Apparatus as in claim 1, wherein:

the air outlet apparatus is located on a side of the carrier roll spaced apart from the entry path and directs the flow of air substantially in a counterflow direction to the stream of induced air moving with the yarn sheet and normally flowing over the surface of the roll, so that the counterflow from the air outlet apparatus entrains surrounding air to create an air flow of greater volume than the volume of air from the nozzle, said air flow engaging and acting on the induced stream of air to separate the induced air stream from the moving yarn sheet before the induced air stream can follow the surface of the carrier roll.

3. Apparatus as in claim 1, wherein:

the air outlet apparatus is located adjacent one surface of the yarn sheet and directs the flow of air in a direction at an acute angle to the yarn sheet and having at least a component concurrent to the path of movement of the yarn sheet, so that the air flow from the air outlet apparatus diverges from the yarn sheet while entraining surrounding air to flow through the moving yarn sheet to follow the air flow diverging away from the one surface of the yarn sheet, whereby the air flow and entrained air separate particulates from the induced stream of air moving with the yarn sheet.

4. Apparatus as in claim 2, further comprising:

a second air outlet apparatus located adjacent one surface of the arriving yarn sheet and operative to direct a second flow of air in a direction at an acute angle to the yarn sheet and diverging from the path of movement of the yarn sheet, so that the air flow from the second air outlet apparatus diverges from the yarn sheet while entraining air to flow through the moving yarn sheet, whereby the second air flow and entrained air separate particulates from the induced stream of air moving with the yarn sheet.

5. Apparatus as in claim 1, wherein:

the air flow apparatus comprises a nozzle having a narrow air outlet slot of length coplanar to the yarn sheet and directing a sheet of air to create a primary air stream that entrains surrounding air to produce the flow of air operative to redirect the induced air stream from the yarn sheet.

6. Apparatus as in claim 1, wherein the nozzle is operative to produce an air flow at a volume to entrain a volume of air greater than the volume flowing from the nozzle.

7. Apparatus as in claim 1, further comprising:

an exhaust outlet positioned to receive the primary air stream and the entrained air and the induced air stream redirected thereby, so as to remove the said air and particulate matter to a location remote from the area occupied by the machine operator.

8. Apparatus for removing a stream of air from a sheet of yarns traveling at a speed sufficient to induce a stream of air with the moving yarn sheet and carrying dust or other particulates, comprising:

a nozzle positioned adjacent the yarn sheet and operative to direct a flow of air toward the induced air stream at a volume and velocity operative to separate the induced air stream from the yarn sheet and redirect the separated air flow along a predetermined exit path for removal from the winding apparatus, whereby the particulates travel with the separated air flow along the exit.

9. A method for redirecting an induced stream of air flowing with a moving sheet of yarn and carrying dust or other particulates, comprising the step of:

directing a flow of air toward the induced air stream at a mass flow rate operative to separate the induced air stream from the moving yarn sheet and to redirect the separated air flow and particulates along a predetermined exit path for removal.

10. The method as in claim 9, comprising:

directing the flow of air in a counterflow direction to the movement of the yarn sheet and at a mass flow rate sufficient to entrain a volume of air, so that the air flow and the entrained air together operate to redirect the induced air stream.

11. The method as in claim 9, in which the moving yarn sheet travels on an entry path toward a carrier roll and wraps part-way around the carrier roll, comprising:

directing the air flow substantially in a counterflow direction to the stream of induced air normally attaching to the roll, so that the counterflow of air acts on the induced air stream to separate the induced air stream from the moving yarn sheet before the induced air stream can attach to the carrier roll.

12. The method as in claim 11, further comprising:

entraining with the counterflow of air a volume of air at least as great as the counterflow, so that the counterflow air and entrained air together redirect the induced air flow.

13. The method as in claim 11, further comprising:

producing a flow of air through the moving yarn sheet upstream from the carrier roll, so that the flow of air through the yarn sheet displaces particulates moving with the moving yarn sheet.

14. The method as in claim 13, wherein:

the flow of air through the yarn sheet is produced by directing a second air flow diverging from the yarn sheet at a location upstream from the yarn sheet so as to entrain air moving with the second air flow and comprising the flow of air through the yarn sheet.

15. The method as in claim 14, wherein:

the second flow of air is directed at an acute angle to the path of the moving yarn sheet so that the second flow of air diverges from the yarn sheet to entrain the air flowing through the yarn sheet.

* * * * *